United States Patent [19]

Waniga

[11] Patent Number: 5,072,349

[45] Date of Patent: Dec. 10, 1991

[54] LIGHTING DEVICE FOR SURGICAL AND MEDICAL USES

[76] Inventor: Howard Waniga, 1312 Berkeley St., Santa Monica, Calif. 90406

[21] Appl. No.: 680,094

[22] Filed: Apr. 3, 1991

[51] Int. Cl.[5] ..... F21V 29/00

[52] U.S. Cl. ..... 362/238; 362/240; 362/250; 362/287; 362/294; 362/373; 362/804

[58] Field of Search ..... 362/804, 240, 238, 250, 362/294, 287, 373

[56] References Cited

U.S. PATENT DOCUMENTS 4,760,507 7/1988 Lasker ..... 362/250

*Primary Examiner*—Carroll B. Dority

*Attorney, Agent, or Firm*—Beehler & Pavitt

[57] ABSTRACT

A directable light device particularly suited for surgical or other medical use wherein preferably three 12 volt halogen lamps with built in dichroic reflectors are mounted in high impact polycarbonate molded receptacles each providing at least two annular vents to remove heat generated by the bulb through a coaxial louvered opening in the back of the housing. Light from the bulbs is also passed through filter means.

12 Claims, 3 Drawing Sheets

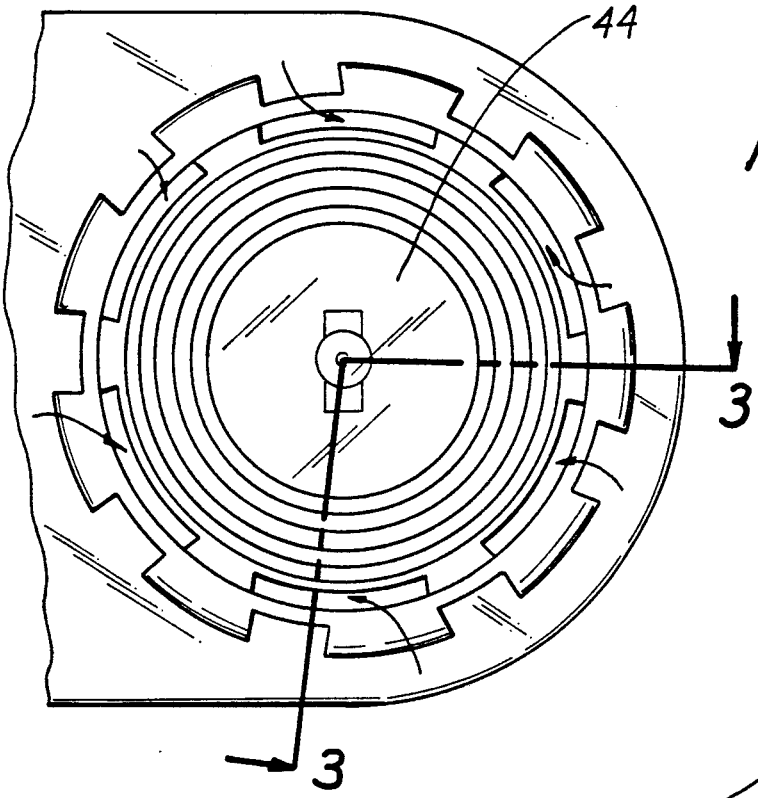
Fig 2
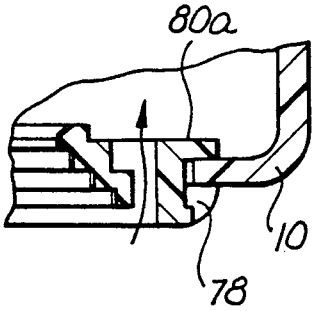
Fig 3a
Fig. 3
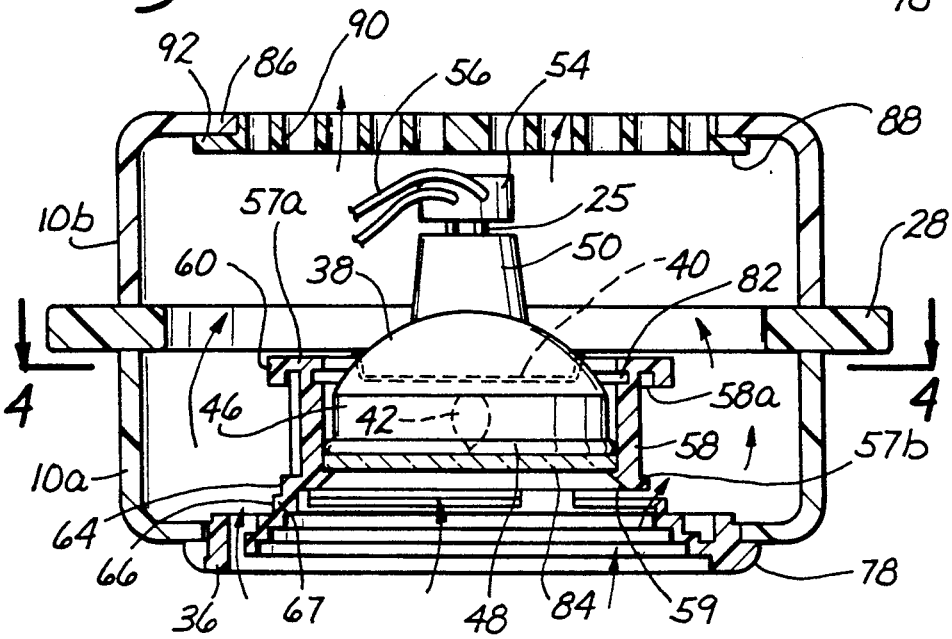

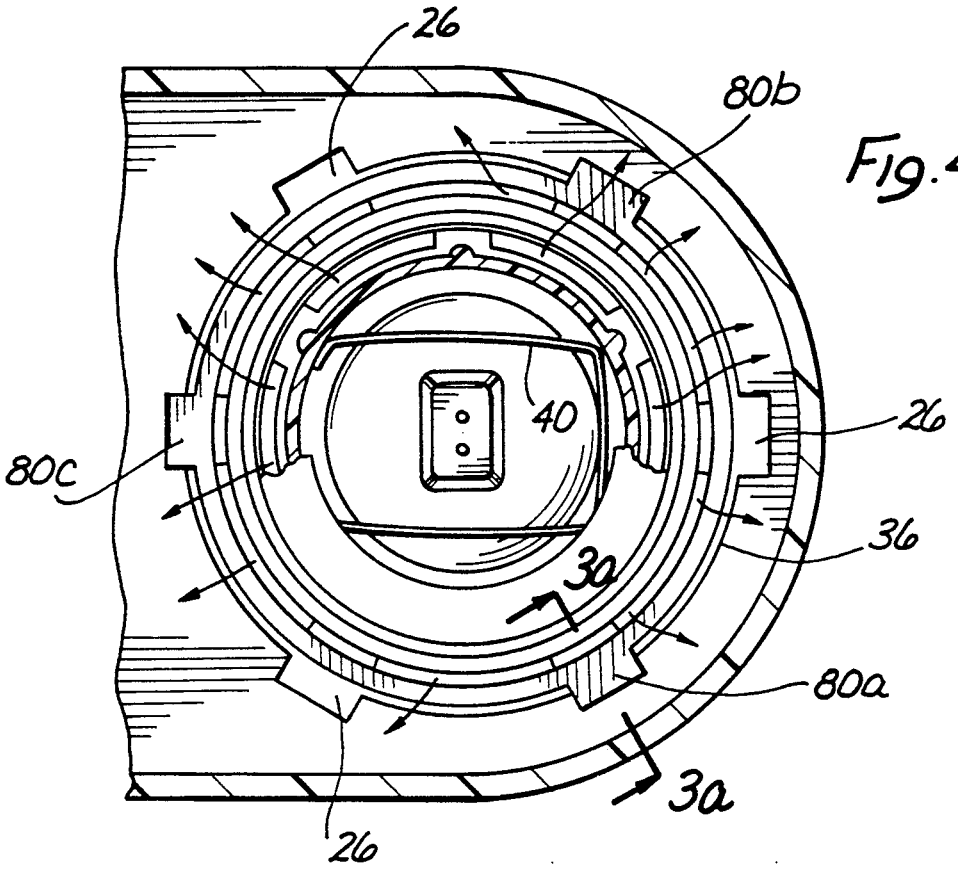
Fig. 4
Fig. 5
PRIOR ART
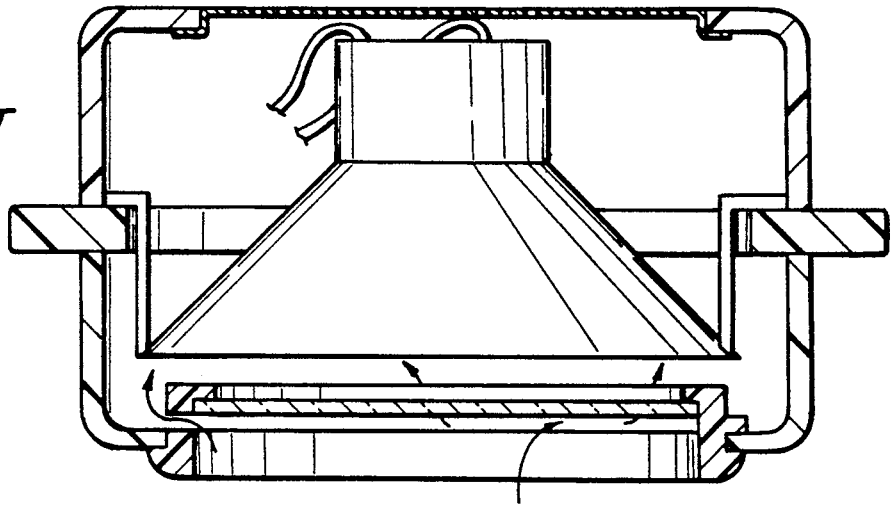

LIGHTING DEVICE FOR SURGICAL AND MEDICAL USES

FIELD OF THE INVENTION

This invention relates in general to the field of lighting fixtures and devices, with particular application to movable lighting devices of the type designed to provide illumination required for surgical procedures and medical examinations.

BACKGROUND OF THE INVENTION

Providing illumination for operations of any kind which involve small objects has always been a problem, particularly where the object is a part of the human anatomy and proper observation and/or modification of the same by surgery or other procedure is involved. Among the desired features for any lighting device directed for application for surgical and medical procedures are: providing illumination of the required intensity, minimizing shadows, minimizing heat and infrared radiation to the work zone and task site and, minimizing ultra-violet radiation. A concern for heat build-up within the lamphead itself with its effect upon the performance and safety of the device upon medical/surgical staff, needs always to be addressed. It is also desirable that any lighting device be extremely safe from the standpoint of possible contact with any high voltage electrical power sources, offer long lamp light, assure that no light bulb breakage would result in glass being dropped onto the subject being operated upon, and prevent any small items from being dropped into the lighting device itself where short circuiting might occur or the items passed through the lighting device and dropped onto the area being operated upon or examined by the surgeon or physician.

DESCRIPTION OF THE PRIOR ART

Numerous minor surgical lighting devices have been devised over the years, but their principal objective appears to have been only to provide illumination of desired intensity in the area to be observed. Such devices have usually disregarded such considerations such as the creation of shadows by the surgeon's hands or instruments, the minimizing of heat and other radiation directed toward the area of operation, and other desired features toward which the present invention is directed.

A previous effort was made by the present inventor to meet certain objections to prior minor surgical and exam lighting devices by providing in a single fixture three lamps having reflective backings and holders which could allow some degree of air circulation. The present invention constitutes a substantial improvement over the prior lighting device in the areas of increased illumination and in decreasing the amount of heat and infra-red radiation being directed at the subject of light focus. As a result, more effective cooling of the lamps, provides an incidental benefit in the form of greatly extended lamp life.

SUMMARY OF THE INVENTION

The present invention minimizes the heat and undesirable radiation which are emitted (by prior art lighting devices of the surgical and medical type), toward the area which receives the lighting concentration by providing in each of the three circular openings in the face of the housing a special receptacle into which is inserted a novel lamp/reflector assembly comprising a low voltage lamp with a unitary dichroic reflector about the lamp, which assembly, when thus inserted, is carried by its receptacle. The receptacle itself is especially designed to hold the lamp/reflector and mount it in the housing with two other similarly mounted lamp/reflector assemblies. Each lamp/reflector assembly contains a front heat filter through which the light passes. In addition, the receptacle provides unique annular spaces forward of the lamp and leading into the housing. The opposite side of the housing is constructed with circular louvered openings disposed coaxially with the openings of the face of the housing. Thus, when the device is directed toward a task site to be illuminated, not only is the heat and radiation which might otherwise reach such area with the light, minimized, but any heat which develops at the outer face of the heat filter will tend to be drawn through the housing by passing first through the uniquely designed and positioned annular spacings into the housing and up and out of the louvered openings on the other side of the housing, i.e. to attain a much improved chimney effect.

The present lighting device thus represents a substantial improvement over lighting devices which have heretofore been available.

BRIEF DESCRIPTION OF THE DRAWINGS

In the accompanying drawings.

FIG. 2 is an underside plan view of one of the three lighting assemblies and receptacle shown in FIG. 1.

FIG. 3 is a section taken on the line 3—3 of FIG. 2.

FIG. 3A is an enlarged corner section of FIG. 3.

FIG. 4 is a plan view of the backside of the lighting assembly of FIG. 3 looking in the direction of the arrows shown in FIG. 3 along the line 4—4.

FIG. 5 is a sectional view corresponding to FIG. 3 of a prior art lighting assembly.

DESCRIPTION OF THE PREFERRED EMBODIMENT

Figure 1:
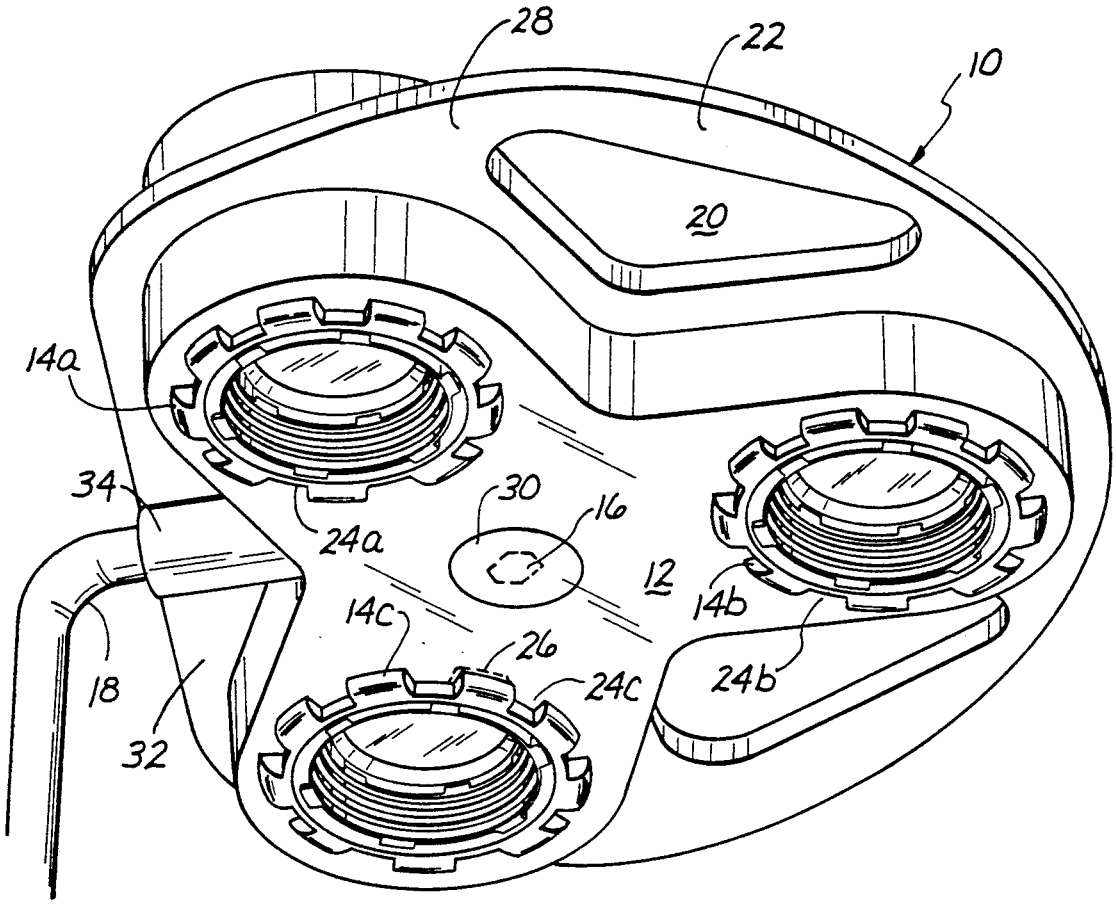
FIG. 1 is a perspective view of the lighting device taken from its underside in its intended downwardly directed orientation.

Referring to FIG. 1, the lighting device of the present invention is comprised of a housing 10 which supports on its underside 12 three lighting assemblies 14*a*, 14*b* and 14*c* disposed equidistantly and equiangularly about a centerpoint 16. The housing 10 may be supported by a flexible goose-neck type element 18, either extending upwardly from a floor stand (not shown) or from some apparatus which itself may be supported on a wall, table, cabinet, bench or ceiling of an operating or examining room.

The housing 10 desirably may be formed of a pair of upper and lower relatively thin walled polycarbonate sections 10*a*, 10*b*, which are clamped together centrally on opposite sides of a rigid plastic frame 28 by threaded elements 30. The frame 28 desirably is provided with a reinforced portion 32 including a tubular section 34 into which an end of the flexible goose-neck type element 18 may be inserted and secured.

The frame 28 may be configured to provide an opening 20 through which a person's hand or fingers may be inserted to grip a rim portion 22 to manipulate the housing 16 so that the lights of the three light may be directed to a desired area.

The underside 12 of the housing 10 is circularly appertured at 24*a*, 24*b* and 25*c*, to receive respectively the three lighting assemblies 14*a*, 14*b* and 14*c*. Each of these appertures 24*a*, 24*b* and 24*c* desirably is radially recessed for a short segment as shown at 26 in FIG. 1, preferably at three locations, each being spaced from the other two locations by 120 degrees.

Referring to FIG. 3, each lighting assembly 14*a*, 14*b* and 14*c* desirably may comprise a receptacle 36 molded of a high impact, high temperature polycarbonite material specially designed to receive an MR-16 lamp/reflector 38 and a lamp retainer spring 40 removably to secure the lamp/reflector 38 in the receptacle. The MR-16 which is sold by, among others, the General Electric Company of Schnectady, N.Y., is itself a unitary element which includes a bulb 42 centrally disposed within a dichroic reflector 44 which is generally hemispherical in shape and terminates in an annular segment 46 capped by a flanged rim 48. A bulb base 50 is permanently secured centrally to the outside of the reflector 44 and includes a pair of plugs 52 adapted to be inserted into a connecting element 54 itself connected by wires 56 to a source (not shown) of a 12 volt electrical current.

The receptacle 36 includes a cylindrical segment 58 having an inside diameter greater than the outside diameter of the flanged rim 48 capping the annular segment 46 of the lamp/reflector 38. The lower end 57*a* of the cylindrical segment 58 terminates in a radially extending flange 60 and the upper end 57*b* of the cylindrical segment 58 has a radially inwardly extending flange 59 with an inner diameter at least slightly greater than the outside diameter of the flanged rim 48 of the annular segment 46 of the lamp/reflector 38.

The upper end 57*b* of the cylindrical segment 58 may also be provided with a small radially outwardly extending flange 64 to which are molded a plurality of support elements 66 extending axially of the cylindrical segment 58 and disposed about the flange 64 and preferably spaced equidistantly from adjacent support elements 66. These members 66 support a first frustoconical, preferably stepped annular member 68 which is flared outwardly from the flange 64 and is held in spaced relationship to the latter flange by the elements 66. A second annular member 70 having an inside diameter sufficiently greater than the base 72 of the first frustoconical stepped member 67 so that when, disposed thereabout, an annular spacing 74 will appear. The second annular member 70 is secured in such spaced relationship to the ring 68 by a plurality of support elements 76 extending between the first annular member 68 and the second annular member 70 with the support members 76 being spaced equidistantly from the adjacent members about the circumference of the base 72 of the annular member 68.

The outside diameter of the second annular member 70 desirably is slightly less than the diameter of the opening 20 in the housing 10. However, extending radially outwardly from the member 68 is an annular flange 78 which, however, may be segmented for the purpose of reducing the amount of material required. In addition, three projections 80*a*, 80*b* and 80*c* are provided to extend radially outwardly as far as the outside diameter of the annular flange segments 78. These projections 80*a*, *b* and *c* are spaced axially below the annular flange segments by at least the thickness of the wall of the housing 10 which defines the opening 20, and are spaced from each other by 120 degrees, or by the same distances about the periphery of the member 68 as the recesses 26 are spaced about their appertures 24*a*, 24*b* and 24*c*.

Inside, and spaced slightly from the end 58*a* of the cylindrical segment 58 is an annular recess 82, the function of which is to receive the retainer spring 40.

As previously indicated, the various components of the receptable 36, namely the cylindrical segment 58, the support members 66, the first frustoconical stepped annular member 68 and the second annular member 70 with the support member 76 desirably are molded as a unitary structure. Each assembly 14*a*, 14*b* and 14*c* also includes a heat resistent glass filter 84. It is also a feature of the present invention to provide in the lower section 10*b* of the housing 10 coaxially with each apperture 24*a*, 24*b* and 24*c* in the underside 12 of the housing 10, a corresponding opening 86 which is covered by a circular louvre assembly 88 formed of a plurality of annular members 90 unitarily molded with a plurality of radiating ribs (not shown). This louvre assembly 88 desirably should also be molded of the same high impact, high temperature of polysulfanate material of which the receptacle 36 is molded and may be permanently seated in an opening 86 by means of its flanged outer ring 92.

To assemble and set up the directable lighting device of the present invention, the wires 56 are connected to a source of current through the flexible goose-neck type element 18 in a parallel connection for each of the lighting assemblies 14*a*, 14*b* and 14*c*. The circular louvres 88 are mounted in the openings 86 in the section 10*b* of the housing 10 and the section 10*b* is then secured to the rigid plastic frame 28 by a threaded element 30. A lighting assembly 14*a*, 14*b* and 14*c* is then made ready for insertion in each of the appertures 24*a*, 24*b* and 24*c* in the section 10*a* of the housing 10. Each assembly 14*a*, 14*b* and 14*c* is put together by inverting a unitarily molded plastic receptacle 36 and first dropping into the cylindrical segment 58 a glass filter 84 to where it seats on the inwardly extending flange 62. An MR-16 lamp/reflector assembly 38 is then similarly inserted within the cylindrical segment 58 to where it rests upon the glass filter 84. Retention within the cylindrical segment is accomplished by inserting the U-shaped retainer spring 40 into the annular recess 82 inside the cylindrical segment 58. The plugs 52 are then pushed into the connecting element 54, following which the entire assembly 14*a*, 14*b* or 14*c* is then dropped into the opening 32, with the projections 80*a*, 80*b* and 80*c* being aligned with the recesses 26 to pass therethrough so that the segmented annular flange 78 comes to rest upon the edge of the housing which defines an apperture 24*a*, 24*b* and 24*c*. By rotating the entire assembly 14*a*, 14*b* and 14*c* for a short distance, it then is held within the opening by the projections 80*a*, 80*b* and 80*c* which have been moved away from the recesses 26 and under the wall of the housing. Thereby, each of the assemblies 14*a*, 14*b* and 14*c* is secured within the section 10*a* of the housing 10, and if not done earlier, section 10*a* of the housing 10 may be secured to the frame 28 by a threaded element 30.

When current is applied to the three lighting assemblies and the housing 10 is turned to direct the lighting assemblies 14*a*, 14*b* and 14*c* downwardly towards a desired area, because of the slight angular orientation provided by the upper half of the housing 10*a*, the lighting from all three of the assemblies 14*a*, 14*b* and 14*c* will be found to come together to form a harmonious pattern which is in focus from 15" to 5 feet below the face of the housing 10*a*. It will also be found that the heat produced by the assemblies thus concentrated is minimized, not only because of the glass filter 84 and low voltage lamp/reflector 38 in each assembly 14*a*, 14*b* and 14*c*, but because of the greatly improved chimney effect provided by the receptacle 36. It will be readily appreciated that any heat which may appear on the outside face of the glass filter 84 of the downwardly directed lighting assemblies 14*a*, 14*b* and 14*c* will tend to rise and pass through the spacing 67 between the flange 64 and the first annular member 68, and further between the spacing 74 between a first annular member 68 and the second annular member 70. As the heat rises and passes through that spacing and into the housing 10, it immediately passes further through the circular louvre assemblies 88 and up and away from the entire lighting device housing 10. Thereby, any heat generated by the several lighting assemblies 14*a*, 14*b* and 14*c*, which is initially minimized by their use of 12 volt bulbs, is further minimized in the area to which the lighting is directed and where the surgeon may be working, or the doctor is examining a patient. The lighting device of the present invention, therefore, constitutes a substantial improvement over prior art lighting devices, such as that shown in FIG. 5 where the only escape for heat generated by the bulb is around the base of the hot bulb itself and the mounting does not produce the air escape effect of the present invention.

What is claimed:

1. A directable light device, said device comprising:

A. a halogen lamp assembly including a bulb, base support means for the bulb, said means serving to hold the bulb and extend it axially in a first direction, said bulb means further providing means extending in a second direction to provide electrical powering connections to illuminate the bulb, and a concave partially spherical dichroic coated reflector disposed co-axially about the bulb to reflect illumination provided by the bulb in said first direction, said reflector terminating outwardly in an annular dichroic band capped by an outwarldy flanged rim having a first outside diameter;

B. a housing, said housing having a front panel and a back panel defining a space between the panels, said front panel of the housing having a circular opening of a second diameter greater than the first diameter;

C. means for mounting said lamp assembly in said opening in the front panel of said housing, said means comprising:

(i) a first circular portion of a third diameter, said third diameter being slightly less than said second diameter but greater than the first diameter, whereby said first circular portion is insertable through said opening; and flange means extending radially outwardly from said first circular portion, thereby to enable said first circular portion to be supported by the front panel of the housing when said first circular portion is inserted through said opening and said flange means is pressed against the front panel, the area of the front panel of the housing defining said circular opening having at least one recess extending radially outwardly, and said first circular portion having a projection extendable in the direction of said recess to pass therethrough and behind the front panel, so that, upon partial rotation of said first circular portion, said first circular portion is removably secured in engagement with the front panel of the housing;

(ii) A second circular portion of a fourth and outer diameter less than the third diameter, but greater than the first diameter, said second circular portion being frusto-conical and disposed coaxially with the first portion, but spaced from and secured to said first portion by a plurality of first rigid elements extending between the first and second circular portions; and (iii) A third circular portion, said third circular portion having an outside diameter less than the fourth diameter but greater than the first diameter, said third diameter portion being disposed coaxially with the second circular portion, but spaced from and secured to said second portion by a plurality of second rigid elements, said third circular portion comprising a cylindrical sleeve section having a first end extending toward the apex of the projected cone of the frusto-conical second portion, and having an inside diameter slightly greater than the said first diameter, said sleeve portion having a second end opposite its first end, said second end having a radially inwardly extending flange of an inner diameter less than said first diameter; said sleeve having means axially inwardly of its said first end to retain said reflector and bulb when said reflector and bulb are inserted through the first end of the sleeve and pressed against its radially inwardly extending flange;

the back panel of said housing having a vented area in substantial alignment with the axis of the cylindrical sleeve section;

whereby heat produced by the illumination of the bulb when the light fixture is directed downwardly, will be largely dissipated by a "chimney effect" by passing through the spacings between the first and second circular portions and second and third circular portions of said means for mounting said lamp assembly, and around the sleeve section and out of the vented area in the back panel of the housing.

2. The directable light device as described in claim 1 wherein a translucent filter is disposed between the outwardly flanged rim of the annular dichroic band of the reflector and the radially extending flange of the sleeve portion of the third circular portion of the means for mounting the lamp assembly.

3. The light device as described in claim 1 wherein the three circular portions comprising the means for mounting the lamp assembly and the first and second rigid elements extending between them are molded as a single unit of a high impact polycarbonite material.

4. The device as described in claim 1 wherein the bulb, its base support means and reflector are formed together as a single unit.

5. The device as described in claim 1 wherein the vented area in the back panel is circularly louvered with minimum spacing between the louvers to allow maximum air passage out of the housing while preventing the entry of small objects into the housing.

6. A directable light device, said device comprising a housing in which at least three devices, each as described in claim 1, is disposed equi-angularly and equidistantly from a single axis with all three of the housing of the claim 1 device being formed together as a single unit.

7. The device as described in claim 6 wherein flexible means are provided to hold the unit and enable it to be oriented in any desired direction and further means are provided to support said flexible means on a floor or from any stationary position.

8. The device as described in claim 7 wherein the bulb is illuminated by a 12 volt current, and transformer means are provided at the support means to convert conventional 110 volt current to 12 volt current and to connect through the flexible means and the housing each of the bulbs in parallel to the 12 volt current.

9. Means for mounting and securing a halogen lamp/reflector assembly to direct the light beam provided by said assembly in a downwardly direction to a preselected area and to minimize the heat and ultraviolet radiation reaching said area, said means comprising:

(A) a cylindrical section having an inside diameter greater than the outside diameter of said assembly, said section having a front end and a rear end;

(B) a circular filter plate adapted to attenuate heat and ultraviolet light passed through it, said filter plate having a diameter slightly less than the inside diameter of the cylindrical section and disposed in the front end of said section, said front end having radially inwardly projecting means to retain said plate co-axially in said front end;

(C) spring means removably retainable in the rear end of said section, said spring means serving to hold said lamp/reflector assembly within said section when said assembly is inserted therein with the lamp face disposed adjacent said plate;

(D) a flared out portion extending from the front end of said section, said flared out portion having at least one substantially annular opening through which heat generated within said portion may pass upwardly around the outside of said section in a "chimney effect"; and (E) means to hold and direct said section and its flared out portion at any desired angle in a downward direction.

10. The means as described in claim 9, wherein the flared out portion defines a plurality of substantially annular openings.

11. The means as described in claim 9, wherein the means to hold and direct the section comprises a housing enclosing said section, said housing having a further opening opposite the rear end of said section and coaxial therewith.

12. The means as described in claim 9, wherein the means to hold and direct the section comprises a housing enclosing said section and two additional similar sections and lamp/reflector assemblies disposed to direct their light rays about a common axis, said housing having a louvered opening opposite the rear end of each said section and coaxial therewith.

* * * * *